United States Patent [19]

Hehl

[11] Patent Number: 4,459,439

[45] Date of Patent: Jul. 10, 1984

[54] KEYBOARD SWITCH ASSEMBLY WITH TOUCH-CENTERING GRID

[76] Inventor: Karl Hehl, Arthur-Hehl-Strasse 32, 7298 Lossburg 1, Fed. Rep. of Germany

[21] Appl. No.: 336,562

[22] Filed: Jan. 4, 1982

[30] Foreign Application Priority Data

Jan. 2, 1981 [DE] Fed. Rep. of Germany ..... 3100053

[51] Int. Cl.[3] ..... H01H 9/00; H01H 13/70

[52] U.S. Cl. ..... 200/5 A; 200/295

[58] Field of Search ..... 200/5 R, 5 A, 159 B, 200/293, 302, 303, 275, 339, 294, 295, 307

[56] References Cited

U.S. PATENT DOCUMENTS

| | | | |
|---|---|---|---|
| 3,286,045 | 11/1966 | Clark, Jr. et al. | 200/295 X |
| 3,619,475 | 11/1971 | Bailey | 200/307 X |
| 3,800,104 | 3/1974 | Lien et al. | 200/5 A |
| 3,962,556 | 6/1976 | Kravchuck | 200/5 R |
| 4,029,915 | 6/1977 | Ojima | 200/5 A X |
| 4,331,851 | 5/1982 | Johnson | 200/5 A X |
| 4,339,634 | 7/1982 | Weber | 200/5 A |

FOREIGN PATENT DOCUMENTS

| | | |
|---|---|---|
| 50-20712 | 3/1975 | Japan . |
| 50-115929 | 9/1975 | Japan . |
| 51-49114 | 4/1976 | Japan . |
| 51-107234 | 8/1976 | Japan . |
| 52-121661 | 9/1977 | Japan . |
| 54-56536 | 4/1979 | Japan . |

*Primary Examiner*—J. R. Scott

*Attorney, Agent, or Firm*—Joseph A. Geiger

[57] ABSTRACT

A keyboard switch assembly comprising a plurality of keyboard switches arranged in a matrix of vertical and horizontal rows, the switches being surrounded by switch cell walls forming a touch-centering grid which, in turn, is surrounded by a front wall and a frame. The switches, supported on shoulders in the open switch cells, are connected to a printed circuit board by means of solder pins. The printed circuit board abuts against the lower extremities of the switch cell walls, being centered by the assembly frame.

8 Claims, 3 Drawing Figures

KEYBOARD SWITCH ASSEMBLY WITH TOUCH-CENTERING GRID

BACKGROUND OF THE INVENTION

1. Field of the Invention

The present invention relates to electronic keyboard controls for processing machines and, more particularly, to a keyboard switch assembly which is equipped with a touch-centering grid and and a printed circuit board and which is adapted for mounting in the control panel of a processing machine.

2. Description of the Prior Art

Keyboard switch assemblies consisting of a matrix of horizontal and vertical rows of depressible switches are commonly used on electronic calculators and, more recently, in connection with push button telephones.

The application of computers and numerical controls to industrial processing machines has made it necessary to replace the customary push buttons and adjustable dials with keyboard switch assemblies for both numerical input and operational control input. Thus, a modern injection molding machine, for example, may have a central control panel with separate keyboards for program input, central operational control input, and separate manual control input.

Experience has shown that, when such a complex processing machine is operated by a less than fully qualified machine operator, input mistakes may be made which range from erroneous data and resulting defective product output to erroneous operational commands and resulting potentially serious damage to the machine. Problems of this kind are not uncommon in less industrialized countries which lack the required pool of skilled technicians, and where an inadequately trained or otherwise unreliable person may be called upon to operate a complex machine.

SUMMARY OF THE INVENTION

Is is therefore the primary objective of the present invention to reduce the potential for input error in a keyboard switch assembly by means of a keyboard structure which makes it impossible for the machine operator to straddle the key buttons, i.e. to touch two adjacent buttons with one finger. Additionally, the keyboard structure is to be simple and capable of assembly as a compact unit, for convenient storage and ease of replacement in case of defect.

The present invention proposes to attain this objective by suggesting a novel keyboard switch assembly in which the keyboard switches are arranged on the upper side of a printed circuit board, in regularly spaced rows of switch positions which intersect one another at right angles, and where the switches are separated by a grid of rigid vertical walls extending to a level near the top of the key members of the switches, so as to physically prevent the simultaneous depression of the key members of any two adjacent keyboard switches with one finger.

In a preferred embodiment of the invention, the touch-centering grid consists of square switch cells and the housings of the keyboard switches have a matchingly square outline. The walls of the switch cells have protruding shoulders cooperating with shoulders of the switch housing to support the latter.

The keyboard switches are preferably also supported on the printed circuit board by means of feet on their switch housings. In addition, the switches are permanently connected to the printed circuit board by means of contact pins engaging contact bushings of the printed circuit board in solder connections.

The invention further suggests the arrangement of an orientation protrusion in each switch cell which, in cooperation with a matching notch in the switch housing, determines the orientation of the latter.

Lastly, the touch-centering grid of the preferred embodiment is surrounded by a front wall and an outer frame of square outline. The latter extends downwardly below the level of the touch-centering grid, so as to receive and center the printed circuit board within its outline. The result is a compact keyboard switch assembly which can be mounted in the control panel of a processing machine as a self-contained unit. A set of locking tongues in the frame walls reduce the mounting procedure to a simple snap-in operation.

BRIEF DESCRIPTION OF THE DRAWINGS

Further special features and advantages of the invention will become apparent from the description following below, when taken together with the accompanying drawing which illustrates, by way of example, a preferred embodiment of the invention, represented in the various figures as follows.

DESCRIPTION OF THE PREFERRED EMBODIMENT

Figure 2:
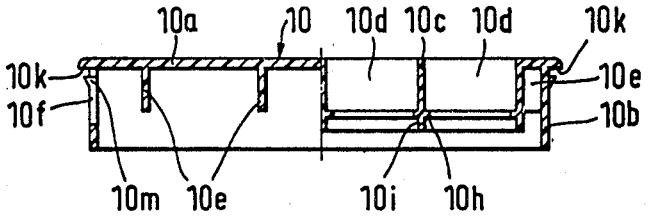
FIG. 2 is a transverse elevational cross section through the frame of FIG. 1, taken along line II—II of FIG. 1.

The drawing shows, by way of a preferred embodiment of the invention, a keyboard switch assembly forming a switch panel a with four vertical rows and four horizontal rows of four switch positions each, for a total of sixteen switch positions in the assembly. One or several such keyboard switch assemblies may be mounted in the control panel of a processing machine such as, for example, a modern injection molding machine.

Figure 3:
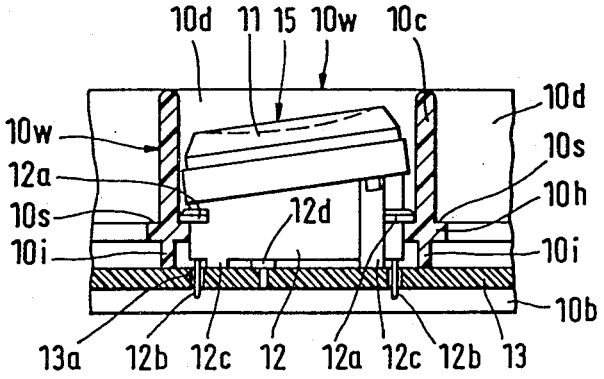
FIG. 3 shows, in an enlarged detail of FIG. 2, a switch cell of the touch-centering grid, complete with printed circuit board and a hinged keyboard switch.

Each switch position of the switch panel a is adapted to be occupied by a switch 15 of which the hinged key portion 11 and the housing 12 are visible in FIG. 3. The switches 15 cooperate with electronic circuit elements of a printed circuit board 13 on the underside of the assembly.

Figure 1:
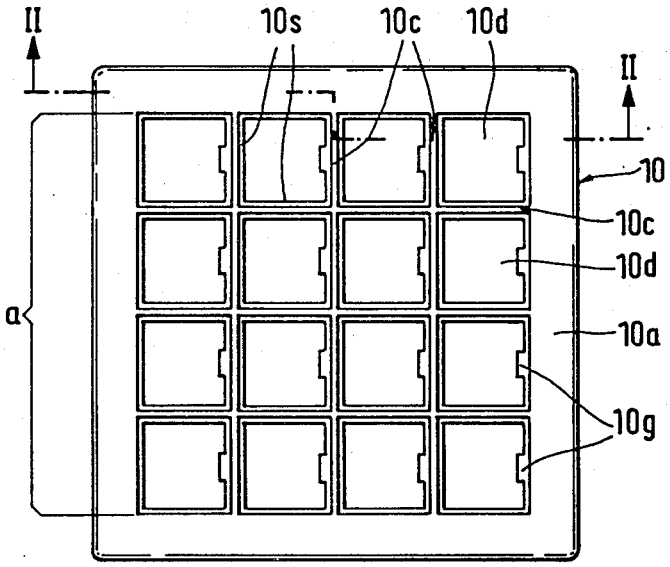
FIG. 1 shows, in a plan view, the frame and touch-centering grid of a keyboard switch assembly with printed circuit board embodying the present invention.

As can be seen in FIGS. 1 and 2, the switch panel a and the printed circuit board 13 are surrounded by frame walls **10*b* of a frame 10. Within the area of the switch panel a, a matrix of intersecting vertical walls 10*w* forms sixteen square switch cells 10*d*, one for each switch 15. The switch cells 10*d* are open at their upper and lower sides. The housings 12 of the switches 15 are of square outline, the switches 15 being insertable into the switch cells 10*d*** from above.

FIG. 3 shows that the cell walls **10*w* of the switch cells 10*d* reach upwardly to a level slightly above the top of the key portions 11. The cell walls 10*w* thereby form a touch-centering grid which prevents the simultaneous depression of any two adjacent key portions 11** with one finger.

The keyboard switch 15 of FIG. 3 has its key portion 11 connected to the switch housing 12 by means of a horizontal pivot axis which, as seen from the direction of the operator, is parallel to, and located near the upper or distal side of the key portion 11. The switch 15 is actuated through finger pressure against its key portion 11, responding, when the normally inclined key portion 11 is pivoted downwardly into a substantially horizontal orientation.

The switch housing 12 has a housing shoulder 12*a* on its circumference with which it rests on interior shoulders 10*s* of the cell walls 10*w*. Thanks to this arrangement, the pressure of a switch-actuating finger on the key portion 11 is not transmitted to the printed circuit board 13, as is the case in other keyboard assemblies, being instead supported by the cell walls 10*w* of the frame 10.

Each switch 15 has at least two contact pins 12*b* engaging matching contact bushings 13*a* of the printed circuit board 13. The switch 15 of FIG. 3 has its two contact pins 12*b* located on opposite sides of the housing 12, i.e. near the upper and lower sides of the switch cell 10*d*, as seen by an operator. A centering pin 12*d* on the bottom of the housing 12 cooperates with a centering bore in the printed circuit board 13 to position the switch 15 in relation to the printed circuit board 13.

Four feet 12*c* of the housing 12 contact the upper surface of the printed circuit board 13 without pressure. Each switch cell 10*d* also has an orientation nose 10*g* in one of its four shoulders 10*s* which, in cooperation with a matching orientation notch (not visible) in the switch housing 12, prevents the insertion of a switch 15 in any other than the correct orientation.

As can be seen in FIG. 3, the cell walls 10*w* with their shoulders 10*s* have a cross section which is composed of a medium-thickness wall portion 10*c* extending over a major upper portion of the cell wall height. The wall portion 10*c* is adjoined by a short maximum-thickness wall portion 10*h* forming the shoulder 10*s*, and the latter is followed by a short thinner wall portion 10*i* on the lower end of the cell wall 10*w*.

The lower extremities of the cell walls 10*w* contact the upper surface of the printed circuit board 13, so that in the assembled state, in which the contact pins 12*b* of the switches 15 are soldered into the contact bushings 13*a* of the printed circuit board 13, the switches 15 and the printed circuit board 13 engage the cell walls 10*w* from opposite sides to form a permanent assembly.

The front wall 10*a* of the frame 10 surrounds the switch panel a at the level of the touch-centering grid, i.e. at the level of the upper extremities of the switch cells 10*d*. Extending downwardly from this front wall 10*a*, at a distance from the outermost cell walls 10*w*, are four frame walls 10*b* in the outline of a concentric square. The frame walls 10*b* are higher than the cell walls 10*w*, so as to form a skirt around the lower openings of the switch cells 10*d*.

The printed circuit board 13 is likewise of square outline, fitting into the skirt portion of the frame walls 10*b*. The front wall 10*a* is flat and parallel to the switch panel a and to the printed circuit board 13. A plurality of short vertical retaining webs 10*e*, extending transversely between the outermost cell walls 10*w* and the frame walls 10*b*, serve to reinforce and stiffen the frame 10.

The front wall 10*a* overhangs the four frame walls 10*b* with an circumferential shoulder 10*k* which, when the keyboard switch assembly is mounted in the front wall of a control panel, abuts against that front wall. Such a control panel (not shown in the drawing) would have a square aperture matching the outer dimensions of the frame walls 10*b*.

For greater mounting ease, the frame walls 10*b* on two opposing sides of the frame 10 form integral locking tongues 10*f* which are separated from the surrounding frame walls 10*b* on three sides. On their resiliently deflectable upper extremities, the locking tongues 10*f* have locking edges 10*m* which protrude laterally outwardly over the frame walls 10*b*, at a distance from the circumferential shoulder 10*k*. This distance corresponds to the thickness of the front wall of the control panel.

With this structure, it is possible to install a keyboard switch assembly in the control panel of a processing machine in a simple snap-in operation in which the laterally protruding locking edges 10*m* deflect inwardly during insertion of the frame walls 10*b* into the aperture of the control panel front wall, snapping back in the fully inserted position of the keyboard switch assembly, to engage the front wall from behind.

The entire frame 10, with its switch cells 10*d* forming a touch-centering grid, its surrounding front wall 10*a*, and its frame walls 10*b*, complete with locking tongues 10*f*, lends itself ideally to production from plastic, as a finished injection-molded part of low cost.

It should be understood, of course, that the foregoing disclosure describes only a preferred embodiment of the invention and that it is intended to cover all changes and modifications of this example of the invention which fall within the scope of the appended claims.

I claim the following:

1. A keyboard switch assembly comprising in combination:

a plurality of keyboard switches arranged side by side, in a planar formation in which one set of regularly spaced rows of switch positions intersects another set of regularly spaced rows of switch positions at right angles, each keyboard switch having a depressible key member on its upper side, and the gap between the key members of adjacent switches being substantially less than the width of a finger;

a printed circuit board arranged underneath the keyboard switches, in a coextensive parallel relationship with said switch formation, each keyboard switch cooperating with a portion of the circuitry on the printed circuit board to produce a switching action, when its key member is depressed in the direction toward the printed circuit board;

means for fixedly positioning the keyboard switches in relation to the printed circuit board; and a grid of rigid vertical walls defining rectangular switch cells around the keyboard switches, the vertical walls extending to a level near the top of the key members of the keyboard switches, for the prevention of the simultaneous depression of the key members of any two adjacent keyboard switches by one finger; and wherein:

each switch housing includes a downwardly facing circumferential shoulder; and the vertical walls forming each switch cell include an upwardly facing shoulder supporting the associated switch housing in a fixed relationship to the printed circuit board by engaging its circumferential shoulder.

2. A keyboard switch assembly as defined in claim 1, wherein the switch cells formed by said grid are of square outline; and the keyboard switches have a switch housing with a matching square circumferential outline.

3. A keyboard switch assembly as defined in claim 1, wherein the vertical walls forming the switch cells have, as seen in vertical cross section, a relatively thin, vertically short wall portion adjoining the printed circuit board, a maximum-thickness vertically short wall portion continuing upwardly therefrom, and an intermediate-thickness, much longer wall portion over the remaining height of the wall, the transition between the intermediate-thickness wall portion and the maximum-thickness wall portion forming said upwardly facing shoulder.

4. A keyboard switch assembly as defined in claim 1, wherein the means for fixedly positioning the keyboard switches in relation to the printed circuit board includes contact leads on the underside of each keyboard switch which are engaged in and electrically connected to contact bushings in the printed circuit board; and the grid of vertical walls enclosing the keyboard switches is held against the printed circuit board by the keyboard switches by virtue of their shoulders engaging said shoulders on the vertical walls.

5. A keyboard switch assembly as defined in claim 1, wherein the switch cells and the housings of the keyboard switches have cooperating walls which define, for each keyboard switch, means for determining a given orientation of the keyboard switch in the keyboard assembly, said means including an orientation protrusion in one, and a matching notch in the other of said cooperating walls.

6. A keyboard switch assembly as defined in claim 1, further comprising a frame surrounding the grid of vertical walls at a circumferential distance, the frame being likewise formed by vertical walls; and a front wall linking the circumferential walls of said grid to the frame walls at the level of the upper edges of the circumferential walls and frame walls, the front wall being in parallel alignment with the printed circuit board.

7. A keyboard switch assembly as defined in claim 6, wherein the walls of the frame are connected to the circumferential walls of said grid by means of connecting ribs extending transversely between said walls.

8. A keyboard switch assembly as defined in claim 7, wherein the walls of the frame extend downwardly to at least the level of the printed circuit board; and the printed circuit board has an outline which is rectangular and of such dimensions that it fits into the frame.

* * * * *